US011015871B2

(12) United States Patent
Wallet-Laily et al.

(10) Patent No.: US 11,015,871 B2
(45) Date of Patent: May 25, 2021

(54) HEAT EXCHANGER ARRANGEMENT

(71) Applicants: Carrier Corporation, Palm Beach Gardens, FL (US); Jeremy Wallet-Laily, Saint Cyr au mont d'or (FR)

(72) Inventors: Jeremy Wallet-Laily, Saint Cyr au mont d'or (FR); Charbel Rahhal, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 193 days.

(21) Appl. No.: 16/098,312

(22) PCT Filed: May 3, 2016

(86) PCT No.: PCT/EP2016/059884

§ 371 (c)(1),
(2) Date: Nov. 1, 2018

(87) PCT Pub. No.: WO2017/190769

PCT Pub. Date: Nov. 9, 2017

(65) Prior Publication Data

US 2019/0162476 A1 May 30, 2019

(51) Int. Cl.
*F24H 3/06* (2006.01)
*F28D 1/04* (2006.01)
(Continued)

(52) U.S. Cl.
CPC ..... *F28D 1/0443* (2013.01); *F28B 1/06* (2013.01); *F28D 1/024* (2013.01); *F28D 1/0471* (2013.01);
(Continued)

(58) Field of Classification Search
CPC ..... F28D 1/0443; F28D 1/024; F28D 1/0471; F28D 1/0476; F28D 1/05366;
(Continued)

(56) References Cited

U.S. PATENT DOCUMENTS 2,268,360 A * 12/1941 Walker ..... F28D 1/047 165/82
3,384,165 A * 5/1968 Mathews ..... F28F 9/0136 165/122
(Continued)

FOREIGN PATENT DOCUMENTS

CN 102141326 A 8/2011
DE 102014226263 A1 * 6/2015 ..... F28F 9/001
(Continued)

OTHER PUBLICATIONS

International Search Report and Written Opinion for application PCT/EP2016/059884, dated Dec. 9, 2016, 12 pages.

*Primary Examiner* — Claire E Rojohn, III
(74) *Attorney, Agent, or Firm* — Cantor Colburn LLP

(57) ABSTRACT

A heat exchanger arrangement (2) comprises at least one heat exchanger (4) including at least one substantially horizontally oriented manifold (6*a*, 6*b*) forming an upper side of the at least one heat exchanger (4), the at least one manifold (6*a*, 6*b*) having lateral end portions (8); and a support structure (10) including a main portion comprising, at least partially, a metallic material, and manifold support portions (14) associated to respective lateral end portions (8) of the at least one manifold (6*a*, 6*b*). The manifold support portions (14) are made at least partially from a non-metallic material and configured to receive the lateral end portions (8) of the at least one manifold (6*a*, 6*b*) for preventing the at least one manifold (6*a*, 6*b*) from contacting any metallic portions of the support structure (10).

19 Claims, 5 Drawing Sheets

(51) Int. Cl.

| | |
|---|---|
| ***F28F 9/00*** | (2006.01) |
| ***F28F 17/00*** | (2006.01) |
| ***F28D 1/047*** | (2006.01) |
| ***F28F 19/00*** | (2006.01) |
| ***F28D 1/053*** | (2006.01) |
| ***F28B 1/06*** | (2006.01) |
| ***F28D 1/02*** | (2006.01) |
| ***F28F 21/08*** | (2006.01) |
| *F28D 21/00* | (2006.01) |
| *F24F 1/40* | (2011.01) |
| *F24F 1/16* | (2011.01) |

(52) U.S. Cl.
CPC ..... *F28D 1/0476* (2013.01); *F28D 1/05366* (2013.01); *F28F 9/001* (2013.01); *F28F 9/002* (2013.01); *F28F 17/005* (2013.01); *F28F 19/00* (2013.01); *F28F 21/084* (2013.01); *F24F 1/16* (2013.01); *F24F 1/40* (2013.01); *F28D 2021/007* (2013.01); *F28F 2009/004* (2013.01); *F28F 2265/26* (2013.01); *F28F 2265/30* (2013.01); *F28F 2275/00* (2013.01)

(58) Field of Classification Search
CPC ..... F28D 2021/007; F28F 9/001; F28F 9/002; F28F 17/005; F28F 19/00; F28F 21/084; F28F 1/16; F28F 1/40; F28F 2009/004; F28F 2265/26; F28F 2265/30; F28F 2275/00; F28B 1/06
USPC ..... 165/122
See application file for complete search history.

(56) References Cited

U.S. PATENT DOCUMENTS 3,472,042 A * 10/1969 Shriver ..... F28D 5/02 62/305
3,701,381 A * 10/1972 Watts ..... F28F 9/013 165/82
3,800,861 A * 4/1974 Flitner ..... F28B 1/06 165/111
4,831,969 A 5/1989 Vollhardt
5,826,649 A * 10/1998 Chapp ..... F28D 1/05375 165/174
6,435,264 B1 * 8/2002 Konno ..... B60K 11/04 123/41.49
6,904,965 B2 * 6/2005 Beck ..... F28D 1/05366 165/153
6,971,444 B2 * 12/2005 Lamich ..... F28D 1/05366 165/173
7,086,249 B2 * 8/2006 Bae ..... F28F 9/0265 62/504
7,331,195 B2 * 2/2008 Bae ..... F25B 39/02 165/174
7,472,744 B2 * 1/2009 Gorbounov ..... F25B 39/028 165/178
7,527,089 B2 * 5/2009 Gorbounov ..... F25B 39/028 165/174
7,640,970 B2 * 1/2010 Kim ..... F28F 9/0275 165/144
7,699,095 B2 * 4/2010 Beamer ..... F28D 1/05366 165/151
7,931,073 B2 * 4/2011 Gorbounov ..... F28F 9/026 165/174
7,967,061 B2 6/2011 Gorbounov et al.
8,037,929 B2 * 10/2011 Higashiyama ..... F28F 9/0253 165/153
8,091,620 B2 * 1/2012 Gorbounov ..... F28D 1/0476 165/173
8,113,270 B2 * 2/2012 Rios ..... F28F 9/0273 165/287
8,225,853 B2 * 7/2012 Macri ..... F25B 39/028 165/174
8,241,459 B2 * 8/2012 Tomlinson ..... B01J 4/002 159/2.1
8,281,615 B2 10/2012 Tucker et al.
8,408,284 B2 4/2013 Polisoto et al.
8,561,680 B2 10/2013 Jiang et al.
8,826,971 B2 9/2014 Xiangxum et al.
10,058,794 B2 * 8/2018 Tomlinson ..... B01D 1/04
10,145,572 B2 * 12/2018 Dinnage ..... F24F 6/06
10,161,658 B2 * 12/2018 Russo ..... F24F 1/06
10,247,482 B2 * 4/2019 Gao ..... F28F 9/02
10,436,458 B2 * 10/2019 Nishimoto ..... F24F 1/16
10,480,817 B2 * 11/2019 Kashihara ..... F24F 13/08
10,533,814 B2 * 1/2020 Vanberg ..... B60K 11/08
10,563,925 B2 * 2/2020 Sakaray ..... F28D 1/05366
2004/0200598 A1 * 10/2004 Hitt ..... B60K 11/04 165/69
2006/0054306 A1 * 3/2006 Kent ..... F28F 9/002 165/67
2009/0173482 A1 7/2009 Beamer et al.
2011/0139410 A1 * 6/2011 Troutman ..... F28F 21/084 165/121
2011/0185574 A1 * 8/2011 Samuelson ..... B21D 11/10 29/890.03
2011/0240276 A1 10/2011 Wintersteen et al.
2012/0279689 A1 * 11/2012 Wang ..... F28F 13/06 165/144
2014/0224460 A1 8/2014 Means
2014/0262147 A1 * 9/2014 Pawlick ..... F28D 1/0426 165/67
2015/0047808 A1 * 2/2015 Takahashi ..... F28D 1/0435 165/67
2015/0107286 A1 * 4/2015 Jin ..... F25B 30/02 62/222
2015/0122455 A1 * 5/2015 Fox ..... F28F 9/0224 165/67
2015/0122470 A1 5/2015 Xia et al.
2015/0292790 A1 * 10/2015 Mastroianni ..... F28D 1/0476 62/285
2015/0377566 A1 * 12/2015 Huazhao ..... F28D 1/05383 165/177
2016/0146550 A1 * 5/2016 Martin ..... F01N 1/00 165/67
2018/0238593 A1 * 8/2018 Wallet-Laily ..... F25B 41/04

FOREIGN PATENT DOCUMENTS

DE 102014226263 A1 6/2015
EP 0012782 B1 6/1983
EP 0856711 A2 8/1998
EP 2851624 A1 * 3/2015 ..... F28F 9/002
EP 2851624 A1 3/2015
JP 2001074201 A 3/2001
JP 2014185810 A 10/2014

* cited by examiner

HEAT EXCHANGER ARRANGEMENT

The application is related to a heat exchanger arrangement, in particular to a heat exchanger arrangement to be used in refrigeration circuits, e.g. in heating, ventilating, air conditioning and refrigeration (HVAC/R) systems.

PRIOR ART

In refrigeration circuits heat exchangers are used for transferring heat between a circulating refrigerant and the environment.

It would be beneficial to provide a heat exchanger arrangement which provides effective heat exchange, which is easy to install, and which has a long life span.

DISCLOSURE OF THE INVENTION

A heat exchanger arrangement according to an exemplary embodiment of the invention comprises at least one heat exchanger and a support structure. The at least one heat exchanger has at least one substantially horizontally oriented manifold forming an upper side of the heat exchanger, the at least one manifold having lateral end portions. The support structure has a main portion comprising, at least partially, a metallic material and manifold support portions associated to respective lateral end portions of the at least one manifold. The manifold support portions are made at least partially from a non-metallic material and configured to receive the lateral end portions of the at least one manifold for preventing the at least one manifold from contacting any metallic portions of the support structure.

In a heat exchanger arrangement according to exemplary embodiments of the invention, there is no metal-to-metal contact between the metallic parts of the at least one heat exchanger and metallic portions of the support structure. This avoids corrosion caused by the electrochemical effect which is likely to occur at the interface of two (different) metals.

In a heat exchanger arrangement according to exemplary embodiments of the invention, the heat exchanger in particular is suspended from the support structure by means of the manifold support portions. Given that in this configuration there is no need for supporting heat exchanger(s) from below, installation of the heat exchanger(s) within the support structure is facilitated. It further facilitates collecting and draining condensate generated on the surface(s) of the heat exchanger(s) in an area below the heat exchanger(s).

In a heat exchanger arrangement according to exemplary embodiments of the invention, the number of contact points between the heat exchanger(s) and the support structure is reduced. This also reduces the number areas where water can accumulate/stagnate and therefore water needs to be drained from in order to avoid corrosion.

Exemplary embodiments of the invention also provide a mechanical decoupling between the heat exchanger(s) and the support structure resulting in an effective damping of vibrations. They further allow compensating for thermal dilatation and deformation of the heat exchanger coils.

Below, a heat exchanger arrangement according to an exemplary embodiment of the invention will be described in detail with reference to the appended figures.

SHORT DESCRIPTION OF THE FIGURES

FIGS. 4*a* to 4*f* are schematic side views illustrating different shapes of heat exchangers as they may be deployed in heat exchanger arrangements according to exemplary embodiments of the invention.

DETAILED DESCRIPTION OF THE FIGURES

Figure 1:
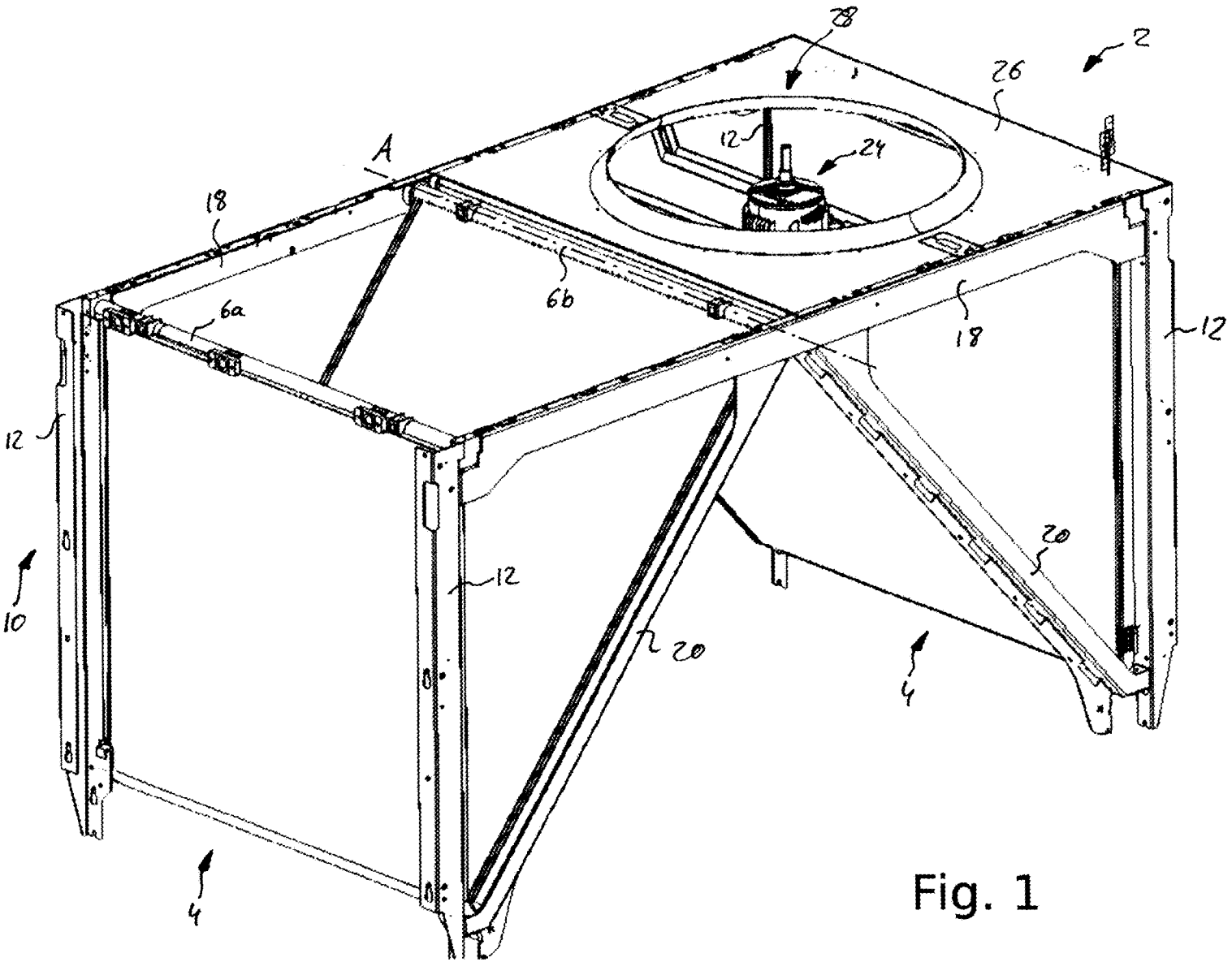
FIG. 1 shows a perspective view of a heat exchanger arrangement according to an exemplary embodiment of the invention.
Figure 2:
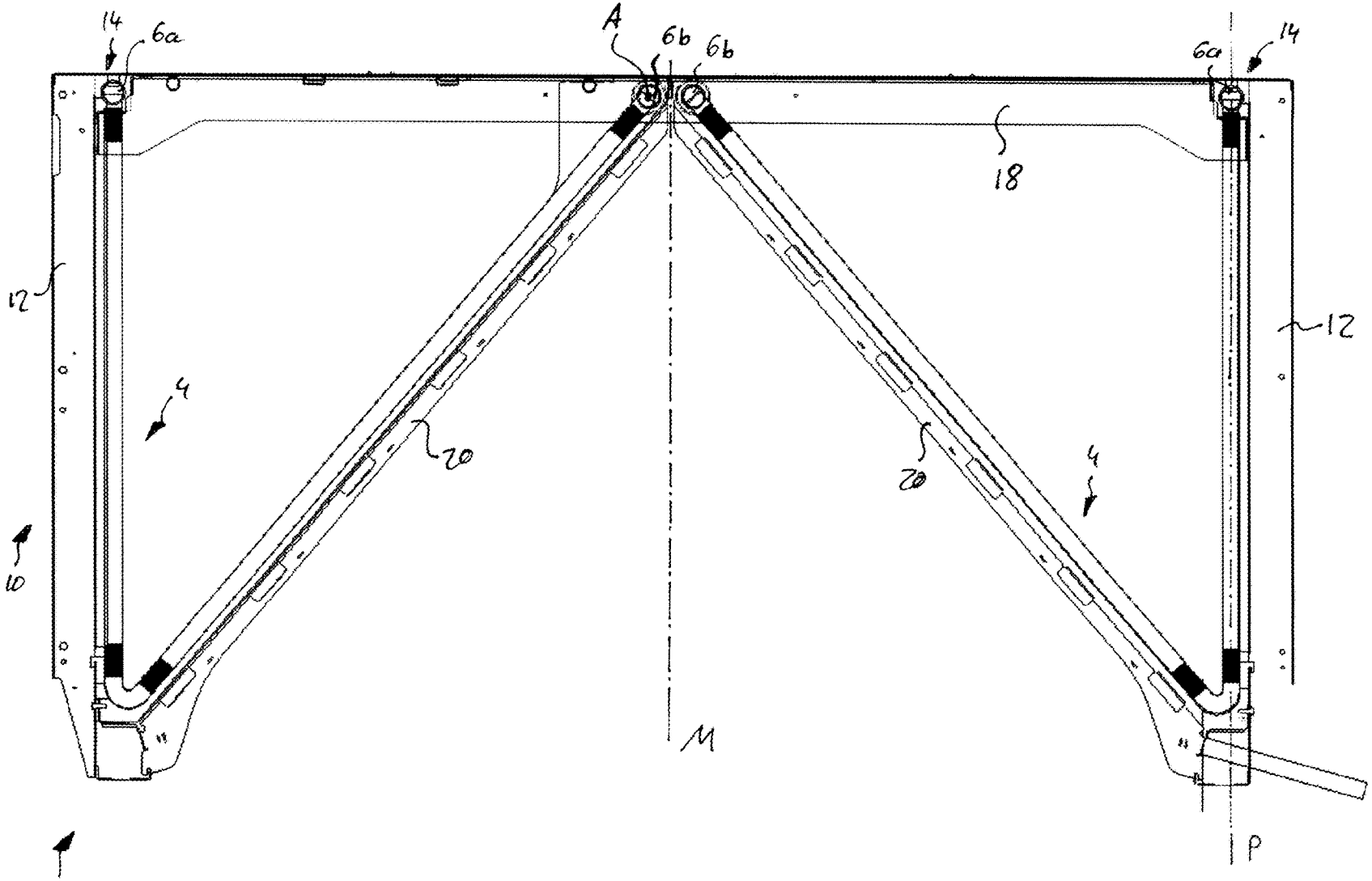
FIG. 2 shows a lateral sectional view of the heat exchanger arrangement shown in FIG. 1.

FIG. 1 shows a perspective view of a heat exchanger arrangement 2 according to an exemplary embodiment of the invention and FIG. 2 shows a lateral sectional view thereof.

The heat exchanger arrangement 2 comprises a support structure 10 provided by a frame consisting of four upright posts 12 and two horizontal beams 18 each connecting upper ends of adjacent upright posts 12.

The support structure 10 further comprises slanted reinforcement struts 20. Each slanted reinforcement strut 20 connects an upright post 12 with a horizontal beam 18 for enhancing the rigidity of the support structure 10.

The exemplary embodiment of the heat exchanger arrangement 2 shown in FIGS. 1 and 2 comprises two V-shaped heat exchangers 4 supported by the support structure 10 that are arranged symmetrically as indicated by dotted line M The V-shape of the heat exchangers 4 will be discussed in more detail further below with reference to FIGS. 4*c* and 4*d*.

As can be seen in FIG. 1, the heat exchanger arrangement may include cover plates 26 supported by the support structure 10. One cover plate 26 covering the right side of the heat exchanger arrangement 2 is shown in FIG. 1. A second cover plate 26, which may be provided for covering the left side of the heat exchanger arrangement 2, is not depicted in FIG. 1 for allowing an unobstructed view into the interior of the heat exchanger arrangement 2. The cover plate 26 is provided with an opening 28 having a circular in shape for housing a fan for generating a flow of air passing the heat exchangers 4. Only the motor 24 but not the propeller of the fan is shown in FIG. 1.

The upper ends of the heat exchangers 4 are provided with manifolds 6*a*, 6*b*, respectively. The plane of projection of FIG. 2 is oriented perpendicular to axis A shown in FIG. 1, i.e. the manifolds 6*a*, 6*b* extend perpendicularly to the plane of projection of FIG. 2.

The manifolds 6*a*, 6*b* are fluidly connected to tubes 22 of the heat exchangers 4. The tubes 22 of the heat exchangers 4 are not visible in FIGS. 1 and 2, but in FIG. 3. The manifolds 6*a*, 6*b* are configured for supplying refrigerant to and collecting refrigerant from said tubes 22, respectively.

Said manifolds 6*a*, 6*b* are further configured to connect the heat exchangers 4 with the support structure 10. This is described below in more detail with reference to FIG. 3.

Figure 3:
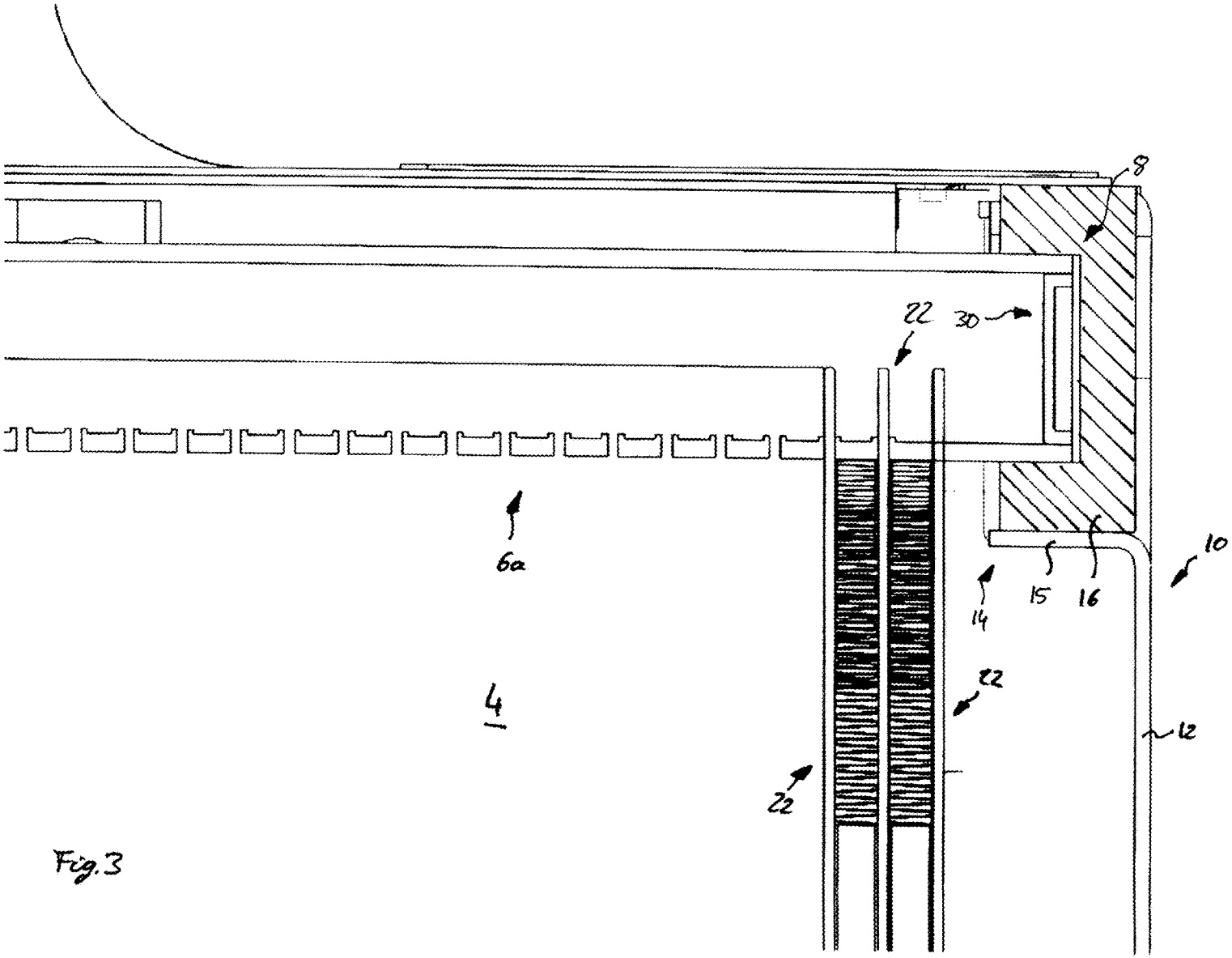
FIG. 3 shows an enlarged sectional view of the area of the heat exchanger arrangement shown in FIGS. 1 and 2 where a heat exchanger is arranged on a support structure.

FIG. 3 shows an enlarged sectional side view of the area in which one of the heat exchangers 4 is connected with the support structure 10, e.g. at the upper right corner of the structure shown in FIG. 2. The plane of projection of FIG. 3, which is depicted by line P in FIG. 2, is oriented perpendicular to the plane of projection of FIG. 2.

The heat exchanger 4 comprises a plurality of tubes 22, three of which are depicted in FIG. 3. The tubes 22 may be multiport tubes 22 and/or tubes 22 provided with fins for enhancing the heat exchange. The tubes 22 extend between a first manifold 6*a* and second manifold 6*b*. The second manifold 6*b* is not shown in FIG. 3. The tubes 22 are fluidly connected with said manifolds 6*a*, 6*b* allowing the manifolds 6*a*, 6*b* to deliver refrigerant to and to collect refrigerant from said tubes 22.

The manifolds 6*a*, 6*b* in particular are provided by hollow pipes extending beyond the lateral edge of the heat exchanger 4 thereby forming lateral end portions 8 protruding from the lateral edges of the heat exchanger 4. The hollow pipes are tightly sealed at both ends by appropriate seals 30, e.g. plugs or caps.

While only the right side of the heat exchanger 4/manifold 6 is shown in FIG. 3, the skilled person will understand that the left side is formed correspondingly.

The support structure 10 comprises manifold support portions 14, only one of which is shown in FIG. 3, which are configured to accommodate the lateral end portions 8 of the manifolds 6*a*, 6*b* protruding from the lateral edges of the heat exchanger 4.

In the exemplary embodiment shown in FIG. 3, the manifold support portion 14 comprises a projection 15 projecting from the inner side of a post 12 of the support structure 10 towards the heat exchanger 4. In an alternative embodiment, which is not shown in the figures, the manifold support portions 14 may be provided by appropriately formed tube segments, which are configured for accommodating the lateral end portions 8 of the manifold 6*a*.

The manifold support portion 14 further comprises a connection element 16 surrounding the respective lateral end portion 8 of the manifold 6*a* and connecting the respective lateral end portion 8 with the projection 15 or tube segment (not shown).

The connection element 16 is made of a non-metallic material, e.g. plastic or a rubber material. This avoids any direct contact between the manifold 6*a*, which usually is made of a metal, and the manifold support portions 14, which usually are also made of metal.

The connection element 16 in particular may be made of an elastic material in order to provide elastic damping between the heat exchanger 4 and the support structure 10 e.g. to decouple vibrations between the heat exchanger 4 and the support structure 10.

In an alternative embodiment which is not shown in the figures, the projections 15 of the manifold support portions 14 themselves may be formed using a non-metallic and/or elastic material such as plastic or rubber. In such an embodiment, no non-metallic connection elements 16 are necessary for preventing direct metal-to-metal contact between the manifold 6*a* and the projections 15.

The projections 15 and/or the connection elements 16 are formed such that there is no direct or immediate contact between the heat exchanger 4 and the support structure 10. Instead, the heat exchangers 4 are attached to the manifold support portions 14 only by the lateral end portions 8 of the manifolds 6*a*, 6*b* and via the (optional) connection elements 16.

Such suspended configuration prevents any direct metal-to-metal contact between the metallic heat exchanger 4 and the metallic support structure 10 and there is no need of additionally supporting the heat exchanger 4. The heat exchanger 4 in particular does not need to be supported from below.

As there is no need for supporting the heat exchanger(s) 4 from below, the collection and drainage of condensate generated on the surface(s) of the heat exchanger(s) 4 in an area below the heat exchanger(s) 4 is facilitated.

Such configuration further provides a mechanical decoupling between the heat exchanger(s) 4 and the support structure 10. This results in an effective damping of vibrations. It further allows compensating for thermal dilatation and deformation of the heat exchanger coils 22.

FIGS. 4*a* to 4*f* are schematic side views illustrating examples of different shapes of heat exchangers 4 as they may be deployed in heat exchanger arrangements 2 according to exemplary embodiments of the invention. In order to achieve an efficient heat exchange, the shapes, in particular the geometries, angles, and dimensions, of the heat exchangers 4 are designed to optimize an almost homogeneous distribution of the air flowing along the surface of heat exchangers 4. The skilled person will understand that the examples shown in FIGS. 4*a* to 4*f* are not exhaustive and that heat exchangers 4 having other shapes may be used as well.

Each of the heat exchangers 4 shown in FIGS. 4*a* to 4*f* comprises a plurality of tubes 22 arranged parallel to each other in a plane extending perpendicular to the plane of projection of FIGS. 4*a* to 4*f*. Therefore, only the first (front most) tube of the plurality of tubes 22 is visible in each of FIGS. 4*a* to 4*f*.

Figure 4D:
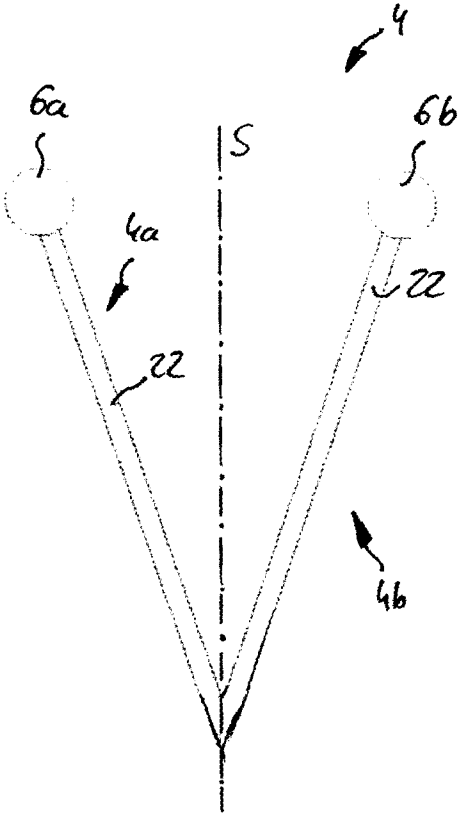
Figure 4C:
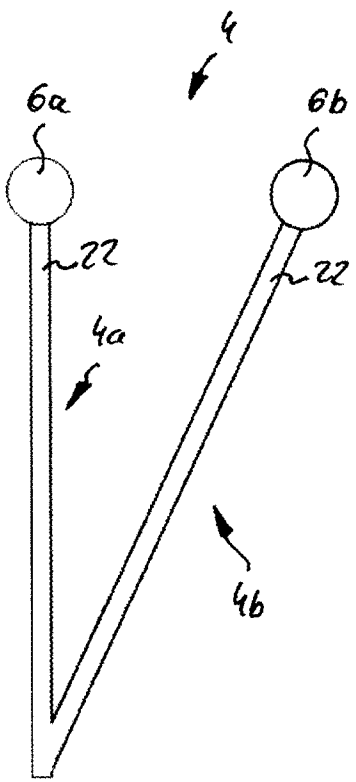
Figure 4B:
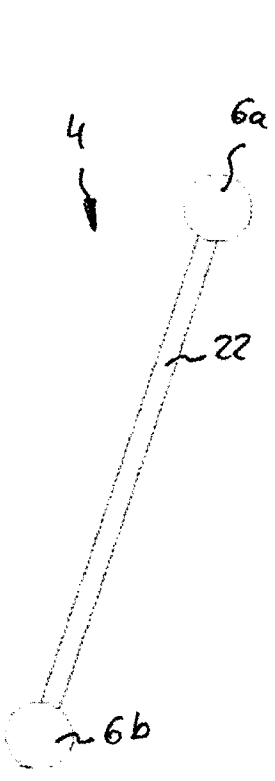
Figure 4A:
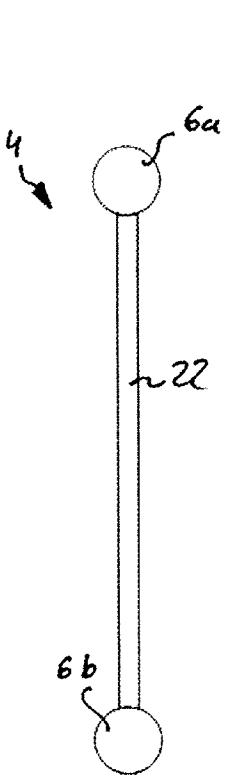

FIG. 4*a* illustrates a shape of a heat exchanger 4 in which the plurality of tubes 22 of the heat exchanger 4 have an I-shape, when seen in a side view, extending vertically from a first (upper) manifold 6*a* to a second (lower) manifold 6*b*.

Such an I-shaped heat exchanger 4 also may be oriented in a slanted orientation with respect to the vertical, as it is depicted in FIG. 4*b*.

FIG. 4*c* depicts a heat exchanger 4 having a V-shape, as it is employed in the heat exchanger assembly 2 shown in FIGS. 1 and 2. The heat exchanger 4 shown in FIG. 4*c* in particular includes a first portion 4*a* extending along a vertical plane down from the first manifold 6*a*, and a second portion 4*b*, which is inclined with respect to said vertical plane. The second portion 4*b* may be inclined at angle of 30° to 60°, particularly at an angle between 40° and 50°, with respect to the vertical plane. A second manifold 6*b* is arranged at the upper end of the second portion 4*b*. The first and second portions 4*a*, 4*b* are fluidly connected to each other at their respective lower ends allowing refrigerant to transfer between the two portions 4*a*, 4*b*.

FIG. 4*d* depicts an alternative V-shaped heat exchanger 4, which is designed symmetrical to a vertically extending plane of symmetry S.

Figure 4F:
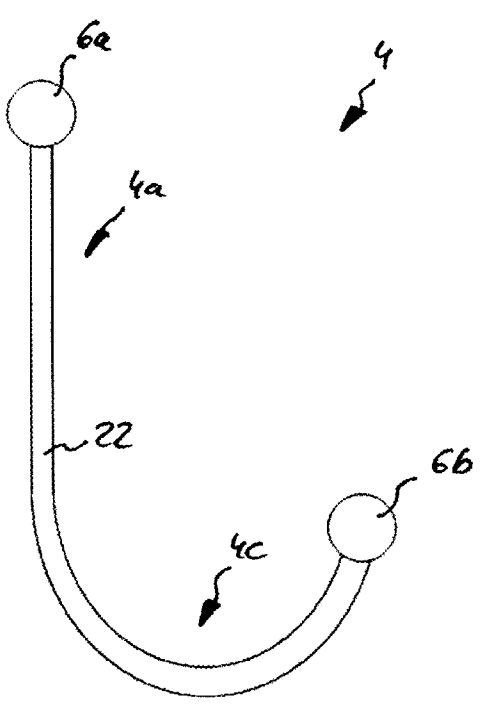
Figure 4E:
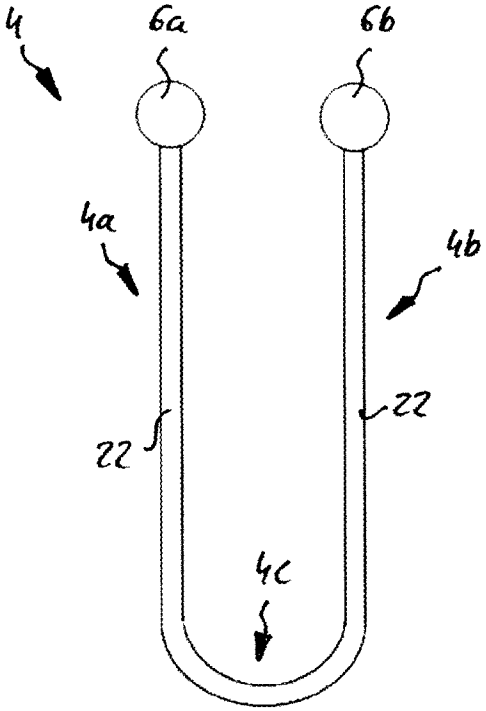

FIG. 4*e* depicts a heat exchanger 4 having a U-form comprising two basically vertical portions 4*a*, 4*b* respectively extending downwards from an upper manifold 6*a*, 6*b* and an arcuate connection portion 4*c* fluidly connecting the lower ends of the two vertical portions 4*a*, 4*b*.

In the embodiment shown in FIG. 4*e*, the two manifolds 6*a*, 6*b* connected to the upper ends of the vertical portions 4*a*, 4*b* of the heat exchanger 4 are arranged at the same height. This, however, is only exemplary. Generally, the manifolds 6*a*, 6*b*/upper ends of the vertical portions 4*a*, 4*b* of the heat exchanger 4 may be arranged at different heights as well.

FIG. 4*f* illustrates another example, in which the second vertical portion 4*b* is omitted and the second manifold 6*b* is attached directly to an upper end of the arched portion opposite to the first vertical portion 4*a*.

In further embodiments, which are not shown in the Figures, the arcuate portion 4*c* may extend further to a different height, and/or an inclined second portion 4*b*, as it is shown in FIG. 4*c*, may be connected to the end of the arcuate portion 4*c* opposite to the first portion 4*a*.

In all embodiments, the refrigerant may flow in parallel through all the tubes 22 from the first manifold 6*a* to the second manifold 6*b*, or vice versa.

Alternatively, the manifolds 6*a*, 6*b* may be divided into at least two sections, respectively, by providing appropriate dividing walls formed within the manifolds 6*a*, 6*b*. Each of said sections may fluidly connect a group of adjacent tubes 22.

Such configuration allows the refrigerant to meander in a counter flow direction through the heat exchanger 4. I.e. the refrigerant may flow through a first group of the tubes 22 from the first manifold 6*a* to the second manifold 6*b* in a first direction, and through a second group of the tubes 22 from the second manifold 6*b* back to the first manifold 6*a* in a second direction, opposite to the first direction. By dividing the manifolds 6*a*, 6*b* into more than two sections, additional flow paths may be added for providing a multi-flow configuration.

In a configuration in which at least one manifold comprises at least one dividing wall, the inlet and the outlet of the heat exchanger 4 may be provided at the same of the two manifolds 6*a*, 6*b* on opposite sides of the at least one dividing wall. Alternatively, the inlet may be provided at a first one of the manifolds 6*a*, 6*b* while the outlet is provided at the second one of the manifolds 6*b*, 6*a*.

Further Embodiments

A number of optional features are set out below. These features may be realized in particular embodiments, alone or in combination with any of the other features.

In one embodiment the manifold support portions of the support structure are provided by non-metallic projections or non-metallic tube segments formed at the inner sides of opposing posts of the support structure at a position of height corresponding to the position of height of the at least one manifold. The lateral end portions of the at least one manifold are received by the respective non-metallic projections or non-metallic tube segments. This allows for an easy installation of the heat exchangers without the need for providing additional non-metallic connection elements for preventing direct metal-to-metal contact.

In another embodiment, the manifold support portions comprise non-metallic connection elements, and the manifold support portions are configured to receive the lateral end portions of the at least one manifold via the respective connection elements for preventing the at least one manifold from contacting any metallic portions of the support structure.

The manifold support portions of the support structure in particular may comprise metallic or non-metallic projections or metallic or non-metallic tube segments located at the inner sides of opposing posts of the support structure at a vertical position corresponding to the vertical position of the at least one manifold and non-metallic connection elements arranged between the respective metallic or non-metallic projections or tube segments and/or associated with the lateral end portions of the at least one manifold. The lateral end portions of the at least one manifold are in particular received by the respective metallic or non-metallic projections or in the respective metallic or non-metallic tube segments via respective non-metallic connection elements.

Such a configuration allows avoiding direct metal-to-metal contact which may cause corrosion due to the electrochemical effect, even in case metallic projections or tube segments are used for connecting the heat exchangers to the support structure. Using metallic projections or tube segments for connecting the heat exchangers may facilitate the construction and/or manufacturing of the support structure.

In another embodiment, the heat exchanger and the support structure are connected only via the lateral end portions of the at least one manifold and otherwise remain spaced apart, i.e. no direct contact is made. This reliably prevents corrosion caused or enhanced by the electrochemical effect.

In another embodiment, the support structure may comprise a plurality, in particular four, upright posts and a plurality, in particular four, horizontal beams to connect adjacent upper ends of the upright posts. Such a configuration provides a support structure with high rigidity at low costs.

In another embodiment, the support structure may additionally comprise slanted reinforcement struts, each slanted reinforcement strut connecting an upright post with a horizontal beam. Providing such reinforcement struts enhances the rigidity of the support structure even further.

In another embodiment, the heat exchanger may comprise first and second manifolds and a plurality of tubes, in particular multiport tubes and/or tubes provided with fins, extending between the first and second manifolds and being fluidly connected with the first and second manifolds. In such a configuration the manifolds allow for efficiently distributing the refrigerant to and for efficiently collecting the refrigerant from the plurality of tubes, respectively.

In another embodiment, the first and second manifolds and the plurality of tubes may have an I-shape, when seen in a vertical cross-section. The first manifold may form an upper manifold and the second manifold may form a lower manifold. The lateral end portions of the upper manifold may be connected with respective manifold support portions of the support structure located at upper end portions of the inner sides of opposing posts of the support structure. The plurality of tubes may in particular extend in a substantially vertical direction. Such a configuration provides a simple heat exchanger which is easy to install and which may be produced at low costs.

In another embodiment, the first and second manifolds and the plurality of tubes may have a V-shape or a U-shape, when seen in a vertical cross-section. The first manifold may provide a left upper manifold arranged at the left upper end of the heat exchanger, and the second manifold may provide a right upper manifold arranged at the right upper end of the heat exchanger. The lateral end portions of the left upper manifold may be connected with respective manifold support portions of the support structure located at upper end portions of the inner sides of opposing posts or beams of the support structure; and the lateral end portions of the right upper manifold may be connected with respective manifold support portions of the support structure located at upper end portions of the inner sides of opposing posts or beams of the support structure.

A heat exchanger comprising tubes having a V-shape or a U-shape provides a large heat-transfer surface allowing for a very effective heat transfer. Installing such a heat exchanger by means of left and right upper manifolds allows for an easy installation and reliable connection of the heat exchanger with the support structure.

In another embodiment, the plurality of tubes having a V-shape may comprise a first, substantially vertical portion and a second portion, which is inclined with respect to the first portion. The first and second sections may be fluidly connected at their respective lower ends. The second inclined portion in particular may be oriented at an angle of 30° to 60°, particularly between 40° and 50°, more particularly at an angle of 45° with respect to the first portion. Such a configuration allows for an effective use of the available space for providing a heat transfer surface which is as large as possible under the given conditions.

In another embodiment, the plurality of tubes having a U-shape may comprise a first and second substantially vertical portion which are fluidly connected by an appropriately rounded/arched connection portion at their lower ends such that the first and second substantially vertical portions are substantially parallel to each other. Such a configuration allows for an effective use of the available space in order to provide a heat transfer surface which is as large as possible.

In another embodiment, the plurality of tubes may have a J-shape, when seen in a vertical cross-section. In this embodiment a first manifold forms an upper manifold and a second manifold forms a lower manifold. The lateral end portions of the upper manifold are connected with respective manifold support portions of the support structure located at upper end portions of the inner sides of opposing posts of the support structure, and the lateral end portions of the lower manifold are connected with respective manifold support portions of the support structure located at intermediate portions of the inner sides of opposing posts of the support structure. The plurality of tubes in particular may comprise a first, substantially vertical portion and a second, rounded portion which is fluidly connected to the lower end of the first portion.

In another, embodiment the heat exchanger arrangement may comprise at least two heat exchangers which are suspended in a common support structure. The heat exchanger arrangement in particular may comprise two V-shaped heat exchangers which are arranged such that their inclined sections face each other. Alternatively, the heat exchanger arrangement may comprise two J-shaped heat exchangers which are arranged such that their rounded sections face each other. Such configurations allow for a very effective use of the available space.

In another embodiment, one of the manifolds may comprise an inlet port and an outlet port, with an inner wall of the manifold subdividing a first space associated with the inlet port and a second space associated with the outlet port. This allows for a counter flow configuration in which the refrigerant flows through a first portion of the plurality of tubes in a first direction through the heat exchanger, and through a second portion of the plurality of tubes in a second, opposite direction through the heat exchanger. Such a configuration may enhance the efficiency of the heat transfer. Providing the inlet port and an outlet port at the same manifold may facilitate the installation of the heat exchanger; in particular less piping might be necessary.

In another embodiment, the heat exchanger arrangement may further comprise at least one fan arranged at or on the support structure. The at least one fan in particular may be arranged horizontally between opposing horizontal beams of the support structure. More particularly, it may be located above an inclined portion of a V-shaped heat exchanger or above a rounded portion of a J-shaped or U-shaped heat exchanger in order to enhance the heat exchange by blowing air through and/or along the surface of the heat exchanger.

In another embodiment, the at least one manifold and/or the tubes are at least partially made of metal, particularly aluminum or an aluminum alloy. Aluminum is a light material and has a high thermal conductivity. Therefore, it allows providing an efficient yet lightweight heat exchanger.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention is not limited to the particular embodiment disclosed, but that the invention does include all embodiments falling within the scope of the appended claims.

REFERENCES

2 heat exchanger arrangement
4 heart exchanger
4*a* first portion of the heart exchanger
4*b* second portion of the heart exchanger
4*c* connecting portion of the heart exchanger
6*a* first manifold
6*b* second manifold
8 lateral end portion
10 support structure
12 post
14 manifold support portion
15 projection
16 connection element
18 horizontal beam
20 reinforcement strut
22 tube
24 fan motor
26 top plate
28 circular opening
30 seal
A axis of a manifold
M mirror plane
P plane of projection of FIG. 3 indicated in FIG. 2
S symmetry plane of a V-shaped heat-exchanger

The invention claimed is:

1. Heat exchanger arrangement (2) comprising:

at least one heat exchanger (4) including at least one horizontal manifold (6*a*, 6*b*) forming an upper side of the at least one heat exchanger (4), the at least one manifold (6*a*, 6*b*) having two lateral end portions (8) protruding from opposing lateral edges of the heat exchanger(4), and a support structure (10) including a main portion comprising, at least partially, a metallic material, and manifold support portions (14) associated to respective lateral end portions (8) of the at least one manifold (6*a*, 6*b*);

wherein the manifold support portions (14) are made at least partially from a non-metallic material and configured to receive the lateral end portions (8) of the at least one manifold (6*a*, 6*b*) so that the at least one heat exchanger (4) is in contact with the support structure (10) only via the lateral end portions (8) of the at least one manifold (6*a*, 6*b*) preventing the at least one manifold (6*a*, 6*b*) from contacting any metallic portions of the support structure (10); and wherein the manifold support portions (14) of the support structure (10) are formed as non-metallic projections (15) located at inner sides of opposing posts (12) of the support structure (10) at a vertical position corresponding to the vertical position of the at least one manifold (6*a*, 6*b*).

2. Heat exchanger arrangement (2) according to claim 1, wherein the lateral end portions (8) of the at least one manifold (6*a*, 6*b*) are supported on the respective non-metallic projections (15) or in the respective non-metallic tube segments.

3. Heat exchanger arrangement (2) according to claim 1, wherein the manifold support portions (14) comprise non-metallic connection elements (16), and the manifold support portions (14) are configured to receive the lateral end portions (8) of the at least one manifold (6*a*, 6*b*) via such non-metallic connection elements (16) for preventing the at least one manifold (6*a*, 6*b*) from contacting any metallic portions of the support structure (10).

4. Heat exchanger arrangement (2) according to claim 3, wherein the manifold support portions (14) of the support structure (10) comprise metallic or non-metallic projections (15) or metallic or non-metallic tube segments located at the inner sides of opposing posts (12) of the support structure (10) at a vertical position corresponding to the vertical position of the at least one manifold (6*a*, 6*b*) and the non-metallic connection elements (16) are arranged between the respective metallic or non-metallic projections (14) or tube segments and the lateral end portions (8) of the at least one manifold (6*a*, 6*b*).

5. Heat exchanger arrangement (2) according to claim 1, wherein the support structure (10) comprises upright posts (12) and horizontal beams (18) respectively connecting adjacent upper ends of the four upright posts (12).

6. Heat exchanger arrangement (2) according to claim 1, wherein the support structure (10) further comprises slanted reinforcement struts (20), each slanted reinforcement strut (20) connecting an upright post (12) with a horizontal beam (18).

7. Heat exchanger arrangement (2) according to claim 1, wherein the at least one heat exchanger (4) comprises a first manifold (6*a*), a second manifold (6*b*) and a plurality of tubes (22), the plurality of tubes (22) extending between the first manifold (6*a*) and the second manifold (6*b*) and being fluidly connected with the first and second manifolds (6*a*, 6*b*).

8. Heat exchanger arrangement (2) according to claim 7, wherein the plurality of tubes (22) have an I-shape, when seen in a vertical cross-section;

wherein the first manifold (6*a*) forms an upper manifold (6*a*) and the second manifold (6*b*) forms a lower manifold (6*b*); and wherein the lateral end portions (8) of the upper manifold (6*a*) are connected with respective manifold support portions (14) of the support structure (10) located at upper end portions (8) of the inner sides of opposing posts of the support structure (10).

9. Heat exchanger arrangement (2) according to claim 7, wherein the plurality of tubes (22) have a V-shape or a U-shape, when seen in a vertical cross-section;

wherein the first manifold (6*a*) forms a left upper manifold (6*a*) and the second manifold (6*b*) forms a right upper manifold (6*b*);

wherein the lateral end portions (8) of the left upper manifold (6*a*) are connected with respective manifold support portions (14) of the support structure (10) located at upper end portions (8) of the inner sides of opposing posts or beams of the support structure (10); and wherein the lateral end portions (8) of the right upper manifold (6*b*) are connected with respective manifold support portions (14) of the support structure (10) located at upper end portions (8) of the inner sides of opposing posts or beams of the support structure (10).

10. Heat exchanger arrangement (2) according to claim 7, wherein the plurality of tubes (22) have a J-shape, when seen in a vertical cross-section;

wherein the first manifold (6*a*) forms an upper manifold (6*a*) and the second manifold (6*b*) forms a lower manifold (6*b*);

wherein the lateral end portions (8) of the upper manifold (6*a*) are connected with respective manifold support portions (14) of the support structure (10) located at upper end portions (8) of the inner sides of opposing posts of the support structure (10); and wherein the lateral end portions (8) of the lower manifold (6*b*) are connected with respective manifold support portions (14) of the support structure (10) located at intermediate portions of the inner sides of opposing posts of the support structure (10).

11. Heat exchanger arrangement (2) according to claim 8, comprising two heat exchangers (4) suspended in a common support structure (10), particularly two V-shaped heat exchangers (4) arranged such that their inclined sections (4*b*) face each other or particularly two J-shaped heat exchangers (4) arranged such that their rounded sections (4*c*) face each other.

12. Heat exchanger arrangement (2) according to claim 1, wherein at least one of the manifolds (6*a*, 6*b*) comprises an inlet port and an outlet port, with an inner wall provided within the at least one manifold (6*a*, 6*b*) subdividing a first space associated with the inlet port and a second space associated with the outlet port.

13. Heat exchanger arrangement (2) according to claim 1, further comprising a fan (24) arranged on the support structure (10), particularly in a horizontal fashion between opposing horizontal beams (18) of the support structure (10), and more particularly above an inclined portion (4*b*) of a V-shaped heat exchanger (4) or above a rounded portion (4*c*) of a J-shaped or U-shaped heat exchanger (4).

14. Heat exchanger arrangement (2) according to claim 1, wherein the at least one manifold (6*a*, 6*b*) are at least partially made of metal.

15. Heat exchanger arrangement (2) according claim 5, wherein the support structure (10) comprises four upright posts (12).

16. Heat exchanger arrangement (2) according claim 7, wherein the plurality of tubes (22) includes multiport tubes.

17. Heat exchanger arrangement (2) according claim 7, wherein the plurality of tubes (22) includes tubes provided with fins.

18. Heat exchanger arrangement (2) according claim 14, wherein at least one of the at least one manifold (6*a*, 6*b*) and the tubes (22) is at least partially made of aluminum or an aluminum alloy.

19. Heat exchanger arrangement (2) according claim 1, wherein the tubes (22) are at least partially made of metal.

* * * * *